United States Patent [19]

Ishii et al.

[11] Patent Number: 4,934,328

[45] Date of Patent: Jun. 19, 1990

[54] METHOD FOR FEEDBACK CONTROLLING AIR AND FUEL RATIO OF THE MIXTURE SUPPLIED TO INTERNAL COMBUSTION ENGINE

[75] Inventors: Junichi Ishii, Katsuta; Matsuo Amano, Hitachi; Nobuo Sato, Iwaki; Nobuo Kurihara, Hitachioota, all of Japan

[73] Assignee: Hitachi, Ltd., Tokyo, Japan

[21] Appl. No.: 310,200

[22] Filed: Feb. 14, 1989

[30] Foreign Application Priority Data

Feb. 24, 1988 [JP] Japan ..... 63-39409

[51] Int. Cl.[5] ..... F02D 41/14

[52] U.S. Cl. ..... 123/489; 123/492; 123/493

[58] Field of Search ..... 123/489, 480, 486, 492, 123/493

[56] References Cited

U.S. PATENT DOCUMENTS

| | | | |
|---|---|---|---|
| 4,467,770 | 8/1984 | Arimura et al. | 123/489 |
| 4,483,300 | 11/1984 | Hosaka et al. | 123/489 |
| 4,627,402 | 12/1986 | Saito et al. | 123/489 |
| 4,703,430 | 10/1987 | Amano et al. | 364/431.05 |
| 4,766,870 | 8/1988 | Nakajima et al. | 123/489 |

FOREIGN PATENT DOCUMENTS

| | | | |
|---|---|---|---|
| 59-23046 | 2/1984 | Japan . | |
| 59-101563 | 6/1984 | Japan | 123/489 |
| 59-101564 | 6/1984 | Japan | 123/489 |

*Primary Examiner*—Andrew M. Dolinar

*Attorney, Agent, or Firm*—Antonelli, Terry & Wands

[57] ABSTRACT

A method for feedback controlling air-fuel ratio of the mixture supplied to an internal combustion engine having a plurality of cylinders comprises the steps of, detecting respective air-fuel ratios of the exhaust gas from the respective cylinders with an air-fuel ratio sensor having a substantially linear output characteristic; calculating an average air-fuel ratio by using the latest detected air-fuel ratios of the respective cylinders; determining a fundamental feedback correction coefficient $\beta_0$ for a cylinder of which air fuel ratio is feedback controlled next; retrieving a learning correction coefficient $\beta_1$ for the cylinder of which air-fuel ratio is feedback controlled next from a learning map prepared by learning for the corresponding cylinder; and determining new learning correction coefficients $\beta_1$ for the respective cylinders using respective deviations of the respective detected current air-fuel ratios from the latest average air-fuel ratio calculated in the previous step, whereby air-fuel ratio control at any desired air-fuel ratio is carried out with a high accuracy and with a uniform air-fuel ratio throughout the whole cylinders.

6 Claims, 11 Drawing Sheets

METHOD FOR FEEDBACK CONTROLLING AIR AND FUEL RATIO OF THE MIXTURE SUPPLIED TO INTERNAL COMBUSTION ENGINE

The present invention relates to a method for feedback controlling an air-fuel ratio of the mixture supplied to an internal combustion engine having a plurality of cylinders and, more particularly, a method for feedback controlling with a learning correction coefficient the air-fuel ratio of the respective cylinders by detecting the respective exhaust gas from the respective cylinders with an air-fuel ratio sensor having a linear output characteristic.

BACKGROUND OF THE INVENTION

U.S. Pat. No. 4,467,770 discloses a method and apparatus for feedback controlling the air-fuel ratio in an internal combustion engine at the stoichiometric air-fuel ratio by using an oxygen sensor having a stepwise output characteristic at the stoichiometric air-fuel ratio wherein an integration compensation factor calculated depending upon detected air-fuel signal and a learning compensation factor determined by the integration compensation factor are used for the feedback control, however the feedback control of the air-fuel ratio is effected at the stoichiometric air-fuel ratio for the engine as a whole without regarding the air-fuel ratios of respective exhaust gas from the respective cylinders.

Japanese Patent Application Laid Open No. 59-23046(1984) discloses an air-fuel ratio feedback controlling apparatus for an internal combustion engine with a plurality of cylinders wherein an air-fuel ratio sensor having a linear output characteristic is used for detecting the respective air-fuel ratio in the exhaust gas from the respective cylinders and the air-fuel ratios of the respective cylinders are feedback controlled, however no learning operation is effected in the apparatus.

SUMMARY OF THE INVENTION

One object of the present invention is to provide a method for feedback controlling an air-fuel ratio of the mixture supplied to an internal combustion engine having a plurality of cylinders at any desired air-fuel ratio ranging from rich to lean including the stoichiometric air-fuel ratio with a high accuracy.

Another object of the present invention is to provide a method for feedback controlling an air-fuel ratio of the mixture supplied to an internal combustion engine having a plurality of cylinders at any desired air-fuel ratio ranging from rich to lean including the stoichiometric air-fuel ratio with a uniform air-fuel ratio throughout the whole cylinders.

A method for feedback controlling air-fuel ratio of the mixture supplied to an internal combustion engine having a plurality of cylinders according to the present invention comprises the steps of, detecting respective air-fuel ratios of the exhaust gas from the respective cylinders with an air-fuel ratio sensor having a substantially linear output characteristic; calculating an average air-fuel ratio by using the latest detected air-fuel ratios of the respective cylinders; determining a fundamental feedback correction coefficient $\beta_0$ for a cylinder of which air-fuel ratio is feedback controlled next; retrieving a learning correction coefficient $\beta_1$ for the cylinder of which air-fuel ratio is feedback controlled next from a learning map prepared by learning for the corresponding cylinder; calculating the fuel injection time Ti for the cylinder of which air-fuel ratio is feedback controlled by using the fundamental feedback correction coefficient $\beta_0$ and the learning correction coefficient $\beta_1$ obtained in the preceding steps; and determining new learning correction coefficients $\beta_1$ for the respective cylinders using respective deviations of the respective detected current air-fuel ratios from the latest average air-fuel ratio calculated in previous step.

DESCRIPTION OF THE PREFERRED EMBODIMENT

Automotive gasoline engines have recently adopted an electronic engine control unit (hereinunder referred to as "EEC") in which a control unit using a microcomputer, for the purpose of total controlling the engine operating state and improving the fuel cost and the state of the exhaust gas, fetches signals from various sensors which represent the operating state of the engine and controls such as the amount of fuel supply and ignition timing, so as to obtain an optimum operating state for the engine.

An example of such systems which adapts the EEC to an internal combustion engine of a fuel injection type will be explained with reference to FIG. 1.

Figure 1:
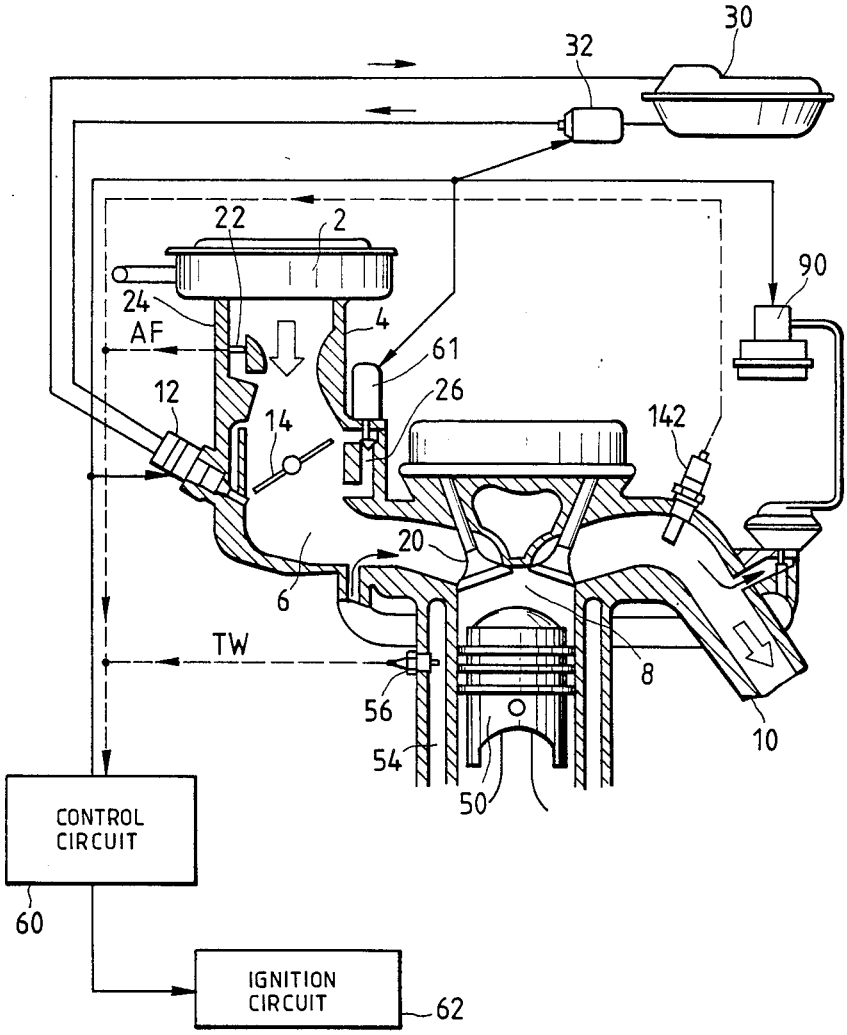
FIG. 1 shows a schematic partially sectional view of an internal combustion engine control system to which the present invention is applied.

FIG. 1 is a schematic partially sectional view of the entire part of an engine control system. Sucked air is supplied to a cylinder 8 through an air cleaner 2, a throttle chamber 4 and an intake conduit 6. The gas combusted in the cylinder 8 is discharged through an exhaust conduit 10 to the atmosphere.

An injector 12 for injecting fuel is disposed in the throttle chamber 4, and the fuel injected from the injector 12 is atomized in the air flow passage within the throttle chamber 4, thereby being mixed with the sucked air to form a fuel-air mixture, which in turn is fed to the cylinder 8 through the intake conduit 6 and an opening of a suction valve 20.

A throttle valve 14 is mechanically coupled with the accelerator pedal so as to be operated by the driver.

An air passage 22 is provided in the upstream side of the throttle valve 14 in the throttle chamber 4. An air flow sensor 24 constituted of such as a hot wire type air flow meter including of an electric heating element is provided in the air passage 22. The air flow sensor 24 produces an electric signal AF which varies in correspondence with the air flow rate.

Pressurized fuel is constantly supplied from a fuel tank 30 to the injector 12 through a fuel pump 32, and the fuel is injected from the injector 12 to the intake conduit 6 when an injection signal is supplied from a control circuit 60 to the injector 12. The fuel-air mixture sucked from the suction valve 20 is compressed by a piston 50 and then undergoes combustion ignited by a spark produced by a spark plug (not shown) provided in each cylinder. The combustion energy thus produced is converted into kinetic energy. The cylinder 8 is cooled by coolant water 54. The temperature of the coolant water is measured by a water temperature sensor 56. The measured value TW is utilized as an engine temperature.

An air-fuel ratio sensor (exhaust gas sensor)142 for outputting a signal which is based on or proportional to the air-fuel ratio (A/F) of the sucked fuel-air mixture is disposed at the junction of the exhaust pipes 10 of the respective cylinders.

A crank angle sensor is provided in connection with a crank shaft (not shown) for producing reference angle signals at every reference crank angle, namely, at every stroke of each cylinder in correspondence with the rotation of the engine, and further producing position signals at every predetermined angle (e.g., 0.5°).

The output of the crank angle sensor, the output signal TW of the water temperature sensor 56, the output signal A/F of the air-fuel ratio sensor 142 and the output signal AF of the air flow sensor 24 are input to the control circuit 60, which consists of a microcomputer, as inputs for controlling the injector 12 and an ignition circuit 62.

A bypass passage 26 for idle speed control is formed in the throttle chamber 4 across the throttle valve 14 in such a manner as to communicate with the intake conduit 6. The bypass passage 26 is provided with a bypass valve 61 for open-and close-control thereof.

The bypass valve 61 is opened and closed by a pulse current from the control circuit 60 and the amount of lift of the bypass valve 61 regulates the cross section of the bypass passage 26. Through the bypass passage 26, the amount of air supplied to the cylinder is controlled.

An exhaust gas recirculation (EGR) control valve 90 controls cross section of a passage between the exhaust conduit 10 and the intake conduit 6, thereby controlling the EGR amount supplied from the exhaust conduit 10 to the intake conduit 6.

Figure 2:
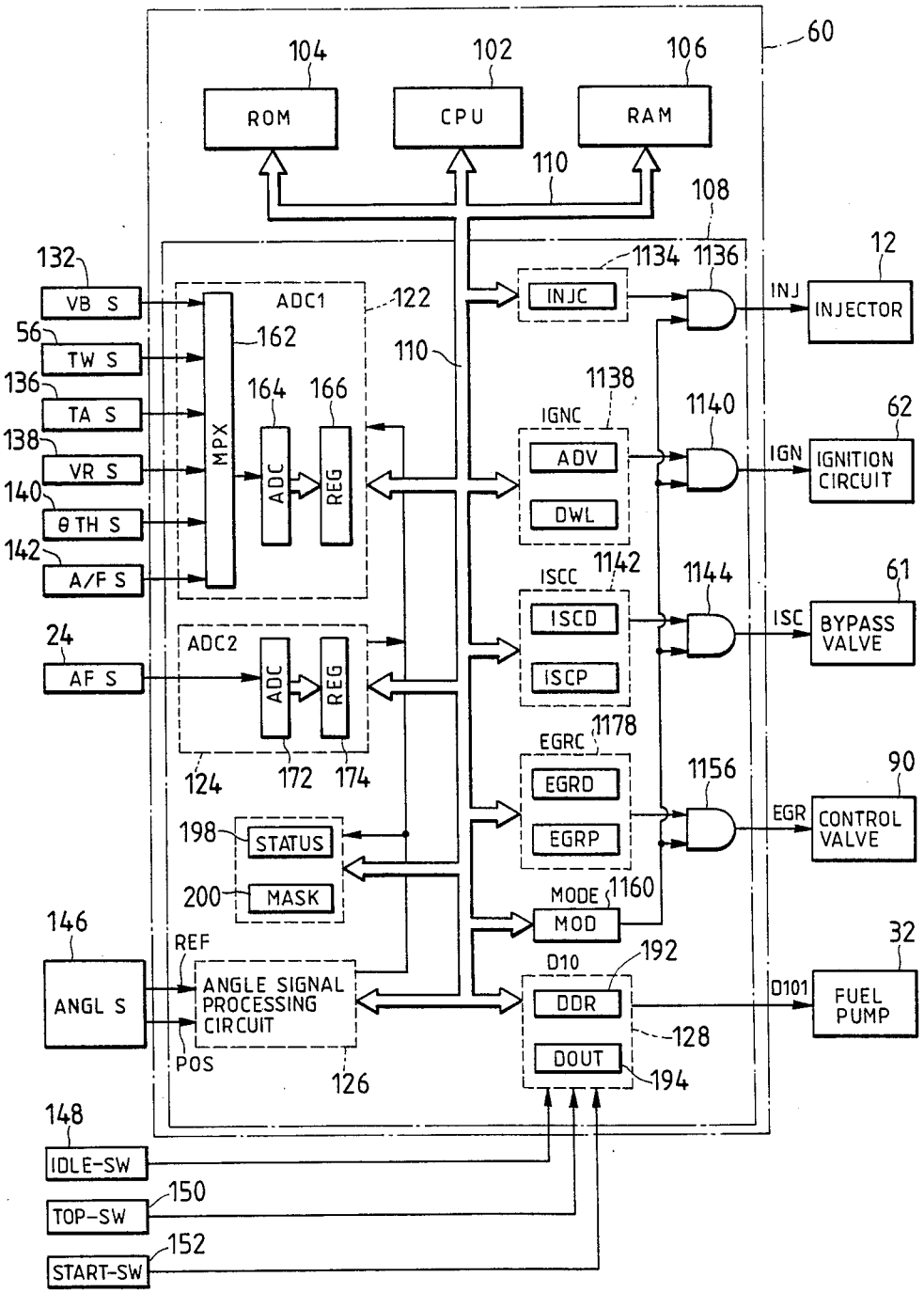
FIG. 2 is a block diagram of the internal combustion engine control system shown in FIG. 1.

FIG. 2 shows the entire part of a control system using a microcomputer. The control circuit 60 includes a central processing unit (hereinunder referred to as "CPU")102, a read only memory (hereinunder referred to as "ROM")104, random access memory (hereinunder referred to as "RAM")106, and an input/output circuit 108. The CPU 102 computes the control variance on the basis of input data from the input/output circuit 108 by the various programs stored in the ROM 104 and feeds the result of the arithmetic operations back again to the input/output circuit 108. Temporary data storage as required for executing the arithmetic operations is accomplished by using the RAM 106. Various date transfer or exchange among the CPU 102, ROM 104, RAM 106 and the input/output circuit 108 is carried out through a bus line 110 composed of a data bus, a control bus and an address bus.

The input/output circuit 108 includes an input means constituted by a first analog digital converter (hereinunder referred to as "ADC1")122, a second analog digital converter (hereinunder referred to as "ADC2")124, an angle signal processing circuit 126 and a discrete input-/output circuit (hereinunder referred to as "DIO")128 for inputting or outputting information of a single bit.

The ADC1 122 includes a multiplexer (hereinunder referred to as "MPX")162 to which outputs are applied from a battery voltage detecting sensor (hereinunder referred to as "VBS")132, the cooling water temperature sensor (hereinunder referred to as "TWS")56, an ambient temperature sensor (hereinunder referred to as "TAS")136, a regulation voltage sensor (hereinunder referred to as "VRS")138, and a throttle sensor (hereinunder referred to as "$\theta$THS")140 and an air-fuel ratio sensor (hereinunder referred to as "A/FS")142. The MPX 162 selects one of these outputs and inputs it to an analog digital converter circuit (hereinunder referred to as "ADC")164. The digital value output from the ADC 164 is stored in a register (hereinunder referred to as "REG")166.

The output of the air flow sensor (hereinunder referred to as "AFS")24 is input to the ADC2 124 and converted into a digital signal through an analog digital converter circuit (hereinunder referred to as "ADC")172. The digital signal is stored in a register (hereinunder referred to as "REG")174.

An angle sensor (hereinunder referred to as "ANGLS")146 outputs a signal of a reference crank angle, e.g., in the case of four cylinders, a signal representing 180° crank angle (this signal will be referred to hereinunder as "REF"), and a signal representative of a minute crank angle, e.g., 0.5° (this signal will be referred to hereinunder as "POS"). These signals are supplied to an angular signal processing circuit 126 and waterform-shaped therein.

To the DIO 128 are input the outputs of an idle switch (hereinunder referred to as "IDLE-SW")148, a top gear switch (hereinunder referred to as "TOP-SW")150 and a starter switch (hereinunder referred to as "START-SW")152.

Pulse output circuits in the input/output circuit 108 operated on the basis of the results of the arithmetic operations of the CPU 60 and the objects of control will be explained hereinunder.

An injector control circuit (hereinunder referred to as "INJC")1134 is a circuit for converting the digital value Ti representing a fuel injection time of the result of the arithmetic operation into a pulse width output. Therefore, a pulse INJ having a pulse width which corresponds to the amount of fuel injection is output from the INJC 1134 and applied to the injector 12 through an AND gate 1136.

An ignition pulse generator circuit (hereinunder referred to as "IGNC")1138 includes a register (hereinunder referred to as "ADV") for setting a digital signal which shows an ignition timing and a register (hereinunder referred to as "DWL") for setting a time for starting to apply a primary current to the ignition coil. These data are set by the CPU 102. A pulse IGN is generated on the basis of the set data and applied to the ignition circuit 62 for supplying the primary current to the ignition coil through an AND gate 1140.

The opening ratio of the bypass valve 61 is controlled by the pulse ISC which is applied from an idle speed control circuit (hereinunder referred to as "ISCC")1142 through an AND gate 1144. The ISCC 1144 includes a register ISCD for setting a pulse width and a register ISCP for setting a pulse frequency.

An EGR amount control pulse generator circuit (hereinunder referred to as "EGRC")1178 for controlling the EGR control valve 90 includes a register EGRD for setting the value representative of the duty of a pulse, and a register EGRP for setting the value representative of a pulse frequency. The output pulse EGR from the EGRC 1178 is applied to an EGR control valve 90 through an AND gate 1156.

Input/output signals of a single bit are controlled by the DIO 128. As the input signals, there are an IDLE-SW signal, a TOP-SW signal and a START-SW signal. As the output signal, there is a pulse output signal for driving the fuel pump 32. The DIO 128 is provided with a register DDR 192 for determining which terminals is used as an input terminal and a register DOUT 194 for latching an output data. From the DIO 128 a signal DIO1 for controlling the fuel pump 32 is output.

A mode register (hereinunder referred to as "MOD")1160 is a register for storing commands for instructing various states in the input/output circuit 108. For example, all of the AND gates 1136, 1140, 1144 and 1156 can be enabled or disabled by a command which is set in the MOD 1160. In this way, the outputs from the INJC 1134, IGNC 1138, ISCC 1142 and EGRC 1178 are controllably initiated and inhibited by setting a command at the MOD 1160.

A status register (STATUS)198 and a mask registor (MASK)200 in combination control interruption to the CPU 102 in the input/output circuit 108.

In this way, the use of such an EEC enables suitable control of almost all factors in an internal combustion engine such as air-fuel ratio and it is easy to conform to the strict exhaust gas regulations for automobiles.

In the EEC shown in FIGS. 1 and 2, fuel is injected by the injector 12 in synchronization with the rotation of the engine. The amount of fuel injection is controlled by the duration for which the valve of the injector 12 is open in one stroke of injection, in other words, the fuel injection time Ti.

The fuel injection time Ti is determined in the following way in the present invention.

$$Ti = Kref \cdot T_P(1+\beta_0+\beta_1)\cdot COEF + T_S \ldots \quad (1)$$

$$T_P = k \cdot Q_A / N \ldots \quad (2)$$

$$Kref = 1/\lambda \ldots \quad (3)$$

wherein k: coefficient determined by the injector specification $Q_A$: flow rate of sucked air N: rotational speed of the engine $T_P$: fundamental fuel injection time $\beta_0$: fundamental feedback correction coefficient $\beta_1$: learning correction coefficient determined by $\beta_0$ COEF: sum of other correction coefficients than $\beta_0$ and $\beta_1$ $T_S$: correction time determined by battery voltage $\lambda$: preset excess air coefficient Kref: inverse of preset air-fuel ratio coefficient The fundamental fuel injection time $T_P$ is calculated from the formula (2) on the basis of the flow rate of sucked air $Q_A$ and the rotational speed N of the engine. The value obtained is multiplied by the inverse of preset air-fuel ratio coefficient Kref so as to obtain a fuel injection time for producing substantially a target air-fuel ratio. The thus-obtained value is corrected by the feedback control variable $\beta_0$ determined by the exhaust gas sensor and the learning control variable $\beta_1$ learned from $\beta_0$, thereby finally obtaining the fuel injection time Ti. The control variable $\beta_0$ is preferably calculated in synchronization with every rotation of the engine in consideration of the idling time and time constant of the engine. The control variable $\beta_0$ is represented by the following difference equation:

$$\beta_0 = K_P e_n + \Sigma K_I e_n K_D (e_n - e_{n-1}) \ldots \quad (4)$$

wherein $K_P$ represents a proportional gain, $K_I$ an integral gain, $K_D$ a differential gain, $e_n$ the present deviation and $e_{n-1}$ the previous deviation from the target air-fuel ratio.

A proportional term $K_P e_n$, an integral term $\Sigma K_I e_n$, and a differential term $K_D(e_n - e_{n-1})$ in the formula (4) respectively constitute a proportional component $\beta_p$, an integral component $\beta_i$ and a differential component $\beta_d$ in the feedback correction coefficient $\beta_0$.

In the present invention, a compensation for the property differences of the individual sensors, actuators, etc. and their change with time and the improvements of operability such as acceleration and deceleration and of emission are effected by learning control while using the control variable $\beta_0$ as a reference.

One embodiment of the present invention will be explained with reference to FIGS. 3, 4, 5, 6 and 7. In this embodiment, when the fuel injection time (amount of fuel injection)Ti is feedback-controlled by using the proportional-integral-differential control (PID control) components shown in the formula (4), the air-fuel ratio for each cylinder is detected from the output of the air-fuel ratio sensor in synchronization with the rotation of the engine and fuel is injected in consideration of the individual differences in air-fuel ratio between the cylinders so as to make the air-fuel ratio uniform throughout the whole cylinders.

Figure 3:
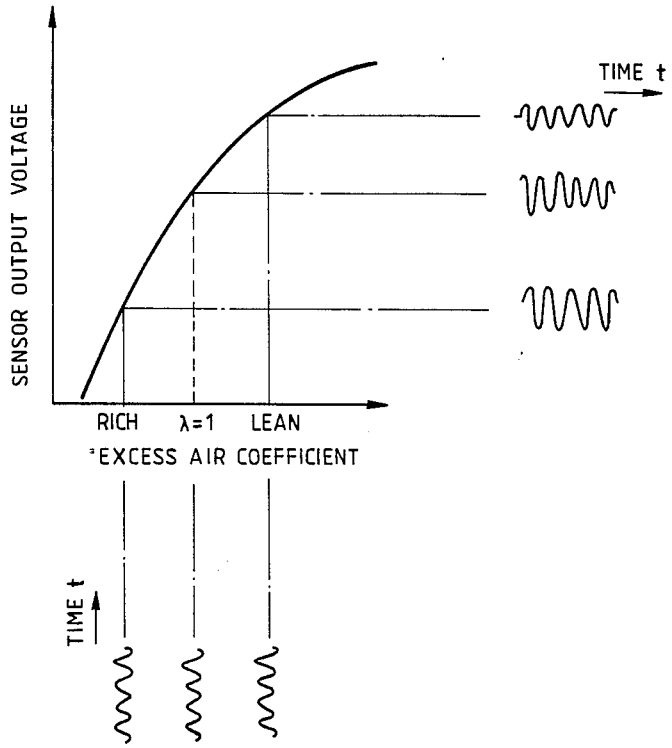
FIG. 3 illustrates output characteristic with respect to excess air coefficient of a linear air-fuel ratio sensor applied to the present invention.

The linear characteristic of the air-fuel ratio sensor used in the present embodiment is shown in FIG. 3. Since the output voltage of the air-fuel ratio sensor with respect to the excess air coefficient, which is the ratio of the air-fuel ratio to the stoichiometric air-fuel ratio, is obtained as a continuous value as shown in FIG. 3, a change in the output voltage of the sensor is obtained with respect to a minute change in each of rich, lean and stoichiometric regions. In contrast, in the case of an. oxygen sensor which is conventionally used for air-fuel ratio control in an internal combustion engine and which has a digital output characteristic in the vicinity of the stoichiometric air-fuel ratio, in that, the output voltage greatly changes in the vicinity of the stoichiometric air-fuel ratio with respect to a minute change in air-fuel ratio, but change in air-fuel ratio is not detectable in the lean or rich region because the output voltage is constant in such a region. Due to the above-described properties, use of the linear air-fuel ratio sensor enables the detection of a change in air-fuel ratio, and since the responsive speed of the sensor is high, the change in air-fuel ratio for each cylinder can be detected.

Figure 4:
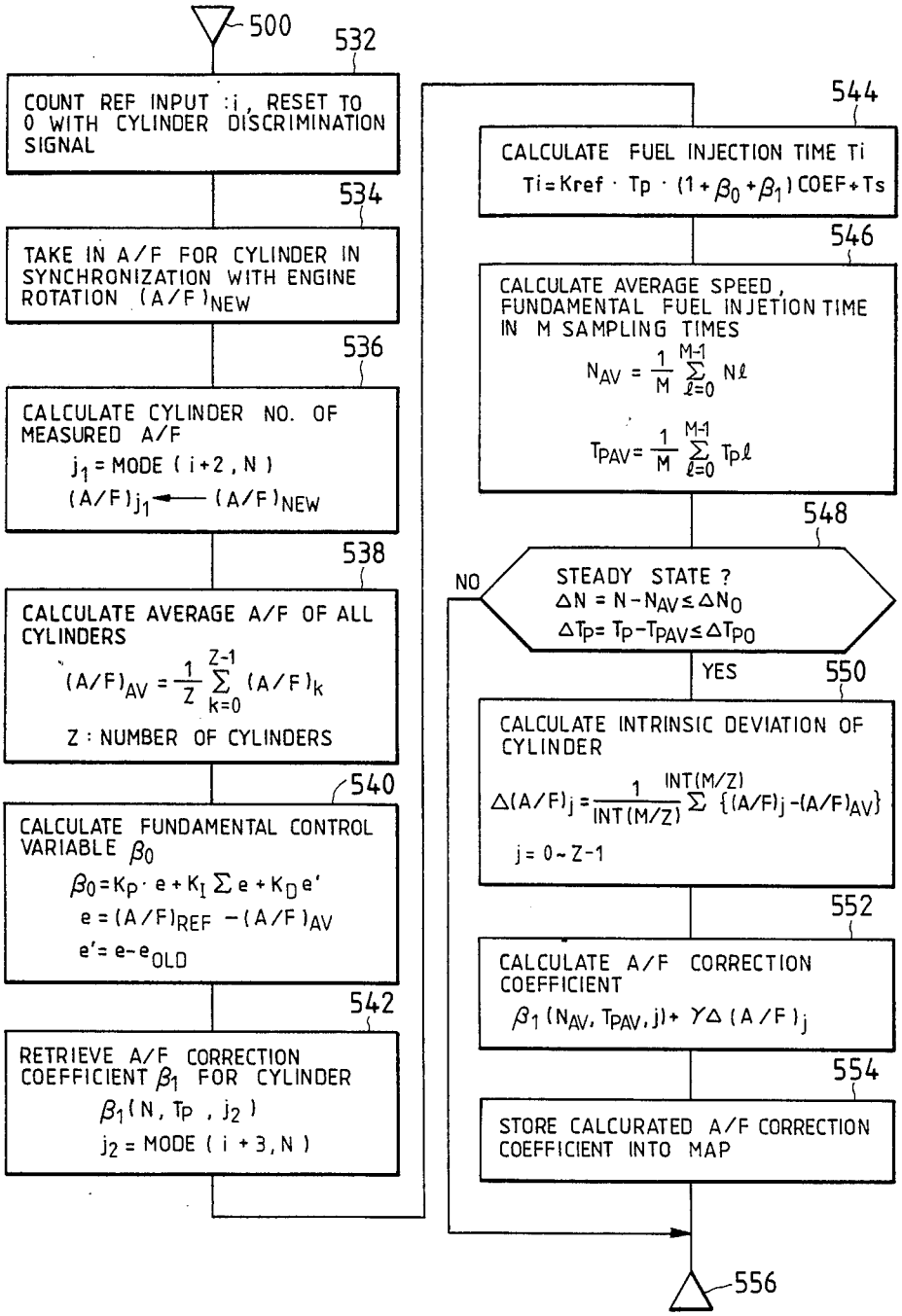
FIG. 4 shows a flow chart for determining a fuel injection time for each cylinder and also determining a learning correction coefficient for each cylinder according to the present invention.
Figure 5:
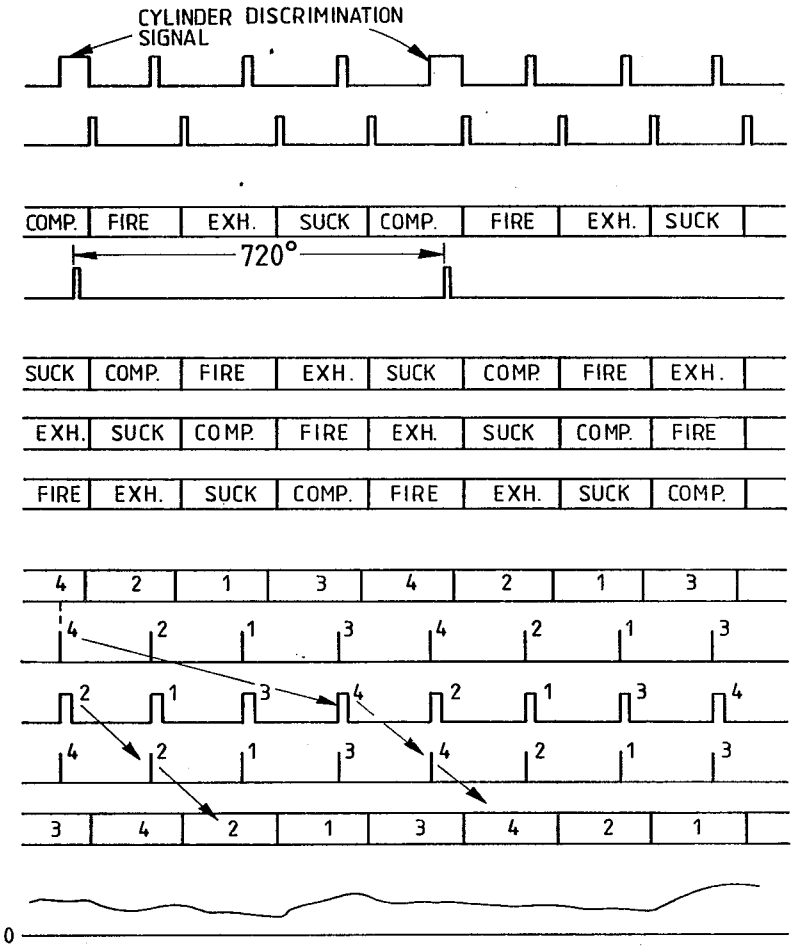
FIGS. 5(*a–m*) are a time chart for explaining the process shown in FIG. 4 including such as strokes of each cylinder and timing of taking in exhaust gas for calculation of fundamental feedback correction coefficient, and of fuel injection respectively for each cylinder.

Referring to FIGS. 4 and 5, when the process reaches the task 500 which is synchronous with the rotation of the engine, the count value of the cylinder signal REF is first input at the step 532. At the rise of the cylinder discrimination signal, the count value is reset to "0". In other words, the counter takes four values of "0", "1", "2"and "3", which are discriminating values corresponding to ignition timing of the first, third, fourth and second cylinders, respectively. At the step 534, the air-fuel ratio for each cylinder is taken through the linear air-fuel ratio sensor in synchronization with the rotation of the engine, and the cylinder discrimination number of which air-fuel ratio has been taken is calculated and stored at the step 536. At the step 538, the average air-fuel ratio of all cylinders is calculated from the air-fuel ratios for the respective cylinders which have been taken lately. At the step 540, the fundamental feedback control variable $\beta_0$ is calculated by using the average air-fuel ratio calculated at the step 538. At this time, the fundamental feedback control variable $\beta_0$ is calculated by using the proportional-integral-differential components shown in the formula (4). A learning air-fuel ratio correction coefficient $\beta_1$ for one cylinder, which is in its turn to be fuel-injection controlled next, is determined at the step 542. The discrimination number of the object cylinder is first calculated, and the learning correction coefficient is retrieved with reference to the number of revolution N, the engine load $T_p$ and the cylinder discrimination number from learning maps for respective cylinders, which will be explained below. At the step 544, the fuel injection time Ti for the object cylinder is calculated from the fundamental feedback control variable $\beta_0$ calculated at the step 540 and the thus-obtained learning air-fuel ratio correction coefficient $\beta_1$ for the object cylinder. The calculation is basically carried out by the formula (1). The present embodiment is characterized in that the sum of the fundamental feedback control variable $\beta_0$, in other words, fundamental feedback correction coefficient and the air-fuel ratio correction coefficient $\beta_1$ for each cylinder is used for controlling air-fuel ratio of an internal combustion engine.

Learning of the air-fuel ratio correction coefficient $\beta_1$ for each cylinder will be described hereinunder. Before determining whether the engine is operating in steady state or not at the step 548, an average engine revolution speed $N_{AV}$ and that of fundamental fuel injection time $T_{PAV}$ during M sampling times, which is a multiple of the cylinder numbers, are calculated at the step 546. The steady state is estimated in the following way at the step 548. When the deviations of the current revolution number N and load of the engine $T_P$ from the average number of revolution $N_{AV}$ and the load of the engine $T_{PAV}$ at past M sampling points are smaller than the respective predetermined values ΔNo and ΔTpo, the engine is judged to be in the steady state.

When the judgment is no, since the air-fuel ratio for each cylinder changes from time to time, no learning operation of the air-fuel ratio correction coefficient for each cylinder is executed. If the engine is judged to be in the steady state at the step 548, the deviation of the air-fuel ratio taken at the step 534 from the average air-fuel ratio calculated at the step 538 intrinsic to the cylinder discriminated at the step 536 is calculated at the step 550. At the step 552, a new air-fuel ratio correction coefficient for the discriminated cylinder is calculated. At this time, the constant multiple of the deviation intrinsic to the cylinder is added to the previous air-fuel ratio correction coefficient for the cylinder to obtain a new air-fuel ratio correction coefficient for the cylinder. The map of the correction coefficient of the air-fuel ratio for the cylinder is renewed by the correction coefficient calculated at the step 552 in preparation for the subsequent retrieval. The process is thus completed. In these processings, the steps until 544 are coaried out in synchronization with the rotation of the engine, however the subsequent steps 546 to 554 may be carried out in another task having a low priority.

FIG. 5 is a time chart of the process explained in connection with FIG. 4 above and the stroke of each cylinder. In the present embodiment, four cylinders are used. In (a) of FIG. 5, the symbol REF represents a cylinder signal. Especially in this case, the cylinder signal which corresponds to the ignition timing of the first cylinder has a large pulse width so as to be used as a cylinder discrimination signal. The strokes of the first and the other cylinders are shown in (c), (e), (f) and (g) of FIG. 5, respectively. The cylinder corresponding to the exhaust gas detected, by the air-fuel ratio sensor having linear characteristics which is disposed at the junction of the exhaust gas, is shown by (h) of FIG. 5 and, for example, when the air-fuel ratio is taken at the rise of the cylinder discrimination signal, it is the air-fuel ratio of the fourth cylinder. Similarly, when the air-fuel ratio is taken in synchronization with the signals as indicated in (i) of FIG. 5, which is the rise of the subsequent cylinder signal, the cylinder corresponding to the signal is the second cylinder, the next are subsequently the first cylinder and the third cylinder. The correction coefficient of the air-fuel ratio for a cylinder calculated at the rise of the cylinder discriminating signal in synchronization with the rotation of the engine is reflected in the fuel injection of the second cylinder. In this way, the fuel injection is controlled cylinder by cylinder according to the predetermined order of processings, such that the air-fuel ratio of each cylinder is feedback controlled with an advance learning correction to a substantially uniform air-fuel ratio.

The air-fuel ratio of the fourth cylinder read at the the rise of the cylinder discriminating signal is used in calculation of the correction coefficient at the following third cylinder signal from the cylinder discriminating signal, and then at the timing of the next cylinder signal, fuel is injected and at the subsequent suction stroke, the fuel is sucked by the fourth cylinder.

Figure 6:
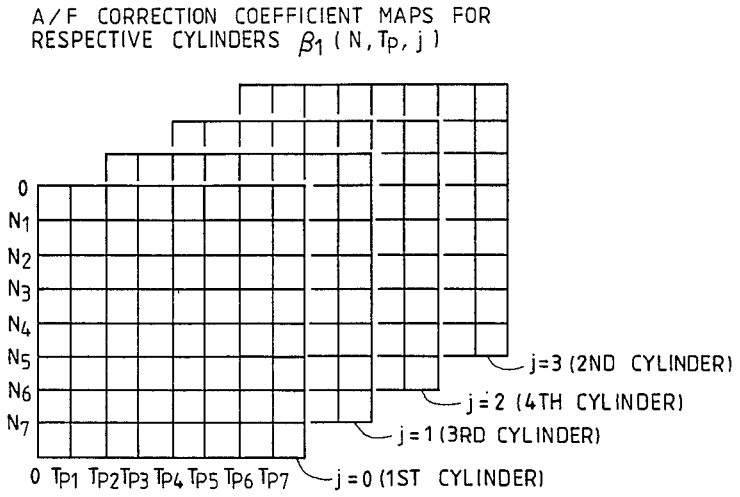
FIG. 6 shows a conceptual constitution diagram of learning maps for respective cylinders storing air-fuel ratio correction coefficient and used in the present invention.

FIG. 6 shows the structure of the map of the air-fuel ratio correction coefficient $\beta_1$ for each cylinder. In this case, the number of revolution N and the load $T_p$ of the engine are divided into eight parts, and each operating region has a learned air-fuel ratio correction coefficient for each cylinder. Since each cylinder has its learning map, four maps are prepared for the present embodiment.

Figure 7:
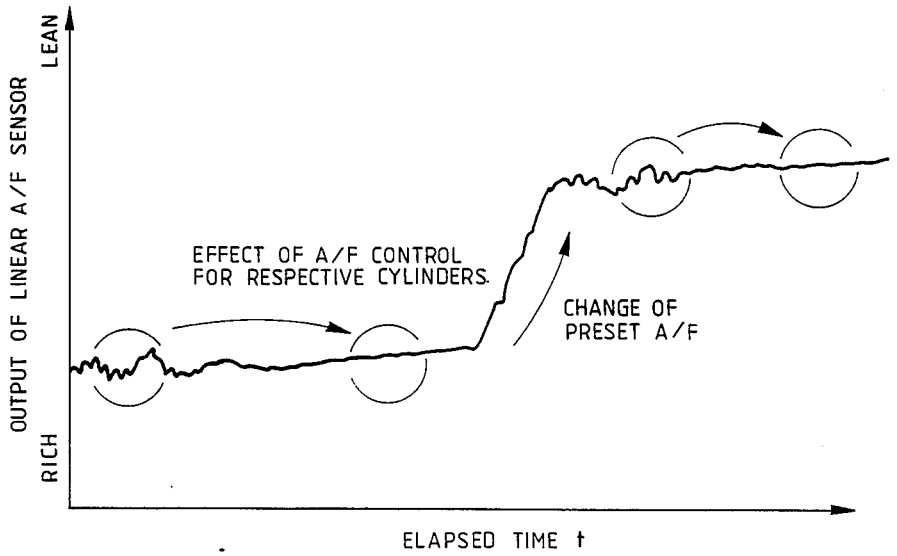
FIG. 7 is a graph illustrating an advantage achieved by the present invention.

FIG. 7 shows an example of the output of the linear air-fuel ratio sensor in the present embodiment. The state is shown in which the output signal having many ripples due to the differences in air-fuel ratio between the cylinders during idling gradually becomes an output signal having fewer ripples, resulting in a uniform air-fuel ratio for each cylinder. After the learning, it is possible to realize an air-fuel ratio more uniform than that at the initial stage. Furthermore, when the preset air-fuel ratio is changed into a new air-fuel ratio, there are differences in the air-fuel ratio between the cylinders at the beginning because no learning has been conducted, but ripples are gradually reduced due to the effect of the learning of the air-fuel ratio correction coefficient for each cylinder, resulting in an air-fuel ratio having few difference between the cylinders.

According to the present embodiment, since it is possible to realize the operation of the engine having a uniform air-fuel ratio between the cylinders in any operating state because there is a map of the air-fuel ratio correction coefficients for each cylinder in accordance with respective operating states, it is possible to increase the preset air-fuel ratio and to save the fuel cost. In addition, since the air-fuel ratio is uniform and the rotational fluctuation is small, engine control having small rotational fluctuation or surging, especially, during idling or a low rotational speed is advantageously enabled.

The learning correction coefficient $\beta_1$ includes a steady state learning correction coefficient $\beta c$ and a transient state learning correction coefficient $\beta dyn$.

Steady state learning for compensating for the property differences and their change with time of the individual sensors, actuators, etc. will first be explained in more detail with reference to FIGS. 8, 9, 10 and 11.

Figure 8:
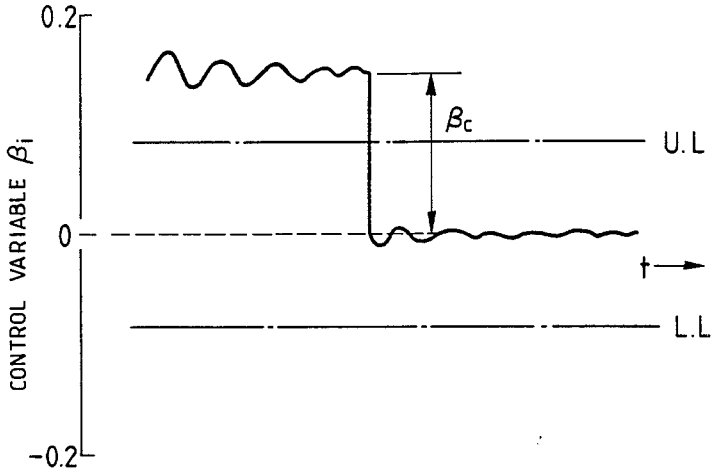
FIG. 8 shows change of an integral component in a fundamental feedback correction coefficient which is used for determining a steady state learning correction coefficient according to the present invention.

A change of the integral component control variable $\beta_i$, which relates to the integral term in formula (4), is shown in FIG. 8. When the control variable $\beta_i$ is beyond the upper limit value (U.L) or under the lower limit value (L.L), the deviation $\beta c$ from zero is adopted as a steady state learning factor. The calculation of the steady state learning factor $\beta c$ is performed in the entire region in which the feedback control is carried out by the exhaust gas sensor 142.

Figure 9:
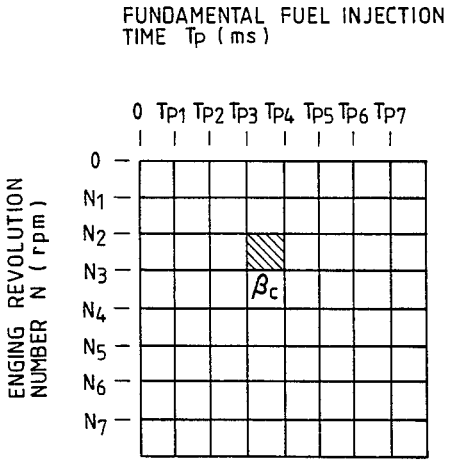
FIG. 9 is a conceptual constitution diagram of a steady state learning map storing learned correction coefficients and used in the present invention.

FIG. 9 shows a table into which the steady state learning factor $\beta c$ is written. In this table, $\beta c$ is written at a divided region defined by the fundamental fuel injection time $T_P$ and the rotational speed N of the engine. The learning is effected at a timing when the divided region does not change and when the control variable $\beta i$ is out of the range of the lower limit value and the upper limit value. Learning is carried out at every divided region such as that shown in FIG. 9. It takes a very long time if learning is carried out over the entire region of the steady state learning map. It is therefore necessary to create unlearned divided regions with reference to the learned regions. A method of creating unlearned divided regions will now be explained with reference to FIG. 10.

Figure 10:
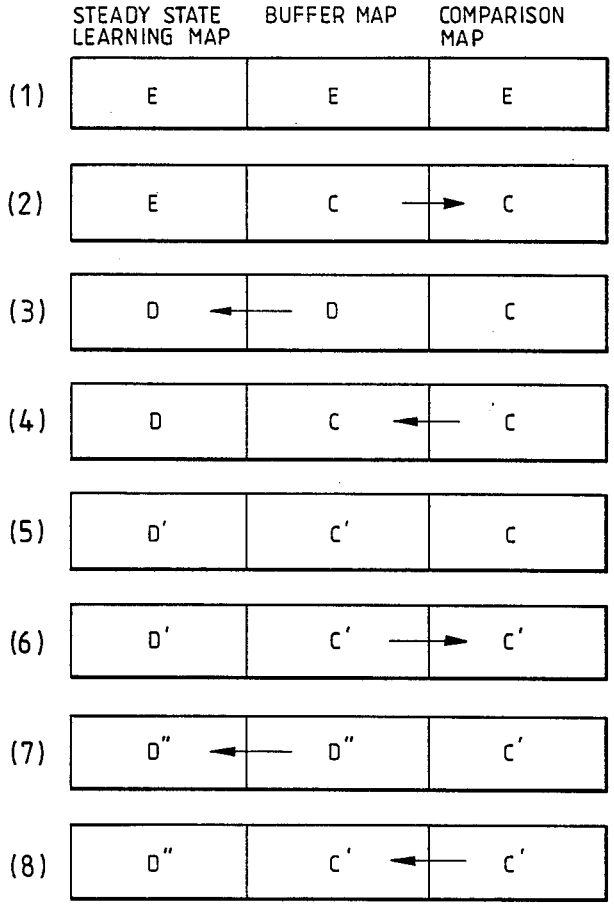
FIG. 10 shows a diagram for explaining an initial and subsequent creation of a learning map used in the present invention.

As shown in FIG. 10, a buffer map and a comparison map having the same number of regions as the divided regions of the steady state learning map are prepared in order to create the steady state learning map.

FIG. 10 is a block diagram for explaining a routine for creating a steady state learning map. In the step (1) of FIG. 10, the steady state learning map and the comparison map are all cleared and the learning factor is to be written in the buffer map. At this point, the buffer map is inhibited from double writing. When the number of written regions becomes c in the step (2), the contents of the buffer map are transferred to the comparison map. In the step (3), all of the unlearned regions of the buffer map are created with reference to the learned contents in the c regions which have been written in the buffer map, and the contents of the thuscreated buffer map are transferred to the steady state learning map. In the step (4), the contents of the comparison map are transferred again to the buffer map. After this point, the learning factor $\beta_c$ in the steady state learning map is used as a learning coefficient for the calculation of the fuel injection time. In and after the step (5), the learning coefficient is written both in the steady state learning map and the buffer map, and the contents of the buffer map are compared with the contents of the comparison map. The difference in the number of written regions between the buffer map and the comparison map reaches a predetermined number, creating operations similar to those carried out in the steps (2) to (4) are executed in the steps (6) to (8). For example, if the number of learned regions c is, 1, since there is a possibility of being a special learning coefficient, weighting is performed so that the half of the learning coefficient $\beta c$ is used as a learning coefficient for all of the unlearned regions. If c is 2, the $\frac{3}{4}$ of the average value of the two learning coefficients $\beta c$ is used as a learning coefficient. If c is 3 or more, the average valve of the three or more learning coefficients $\beta c$ itself is used as a learning coefficient.

Figure 11:
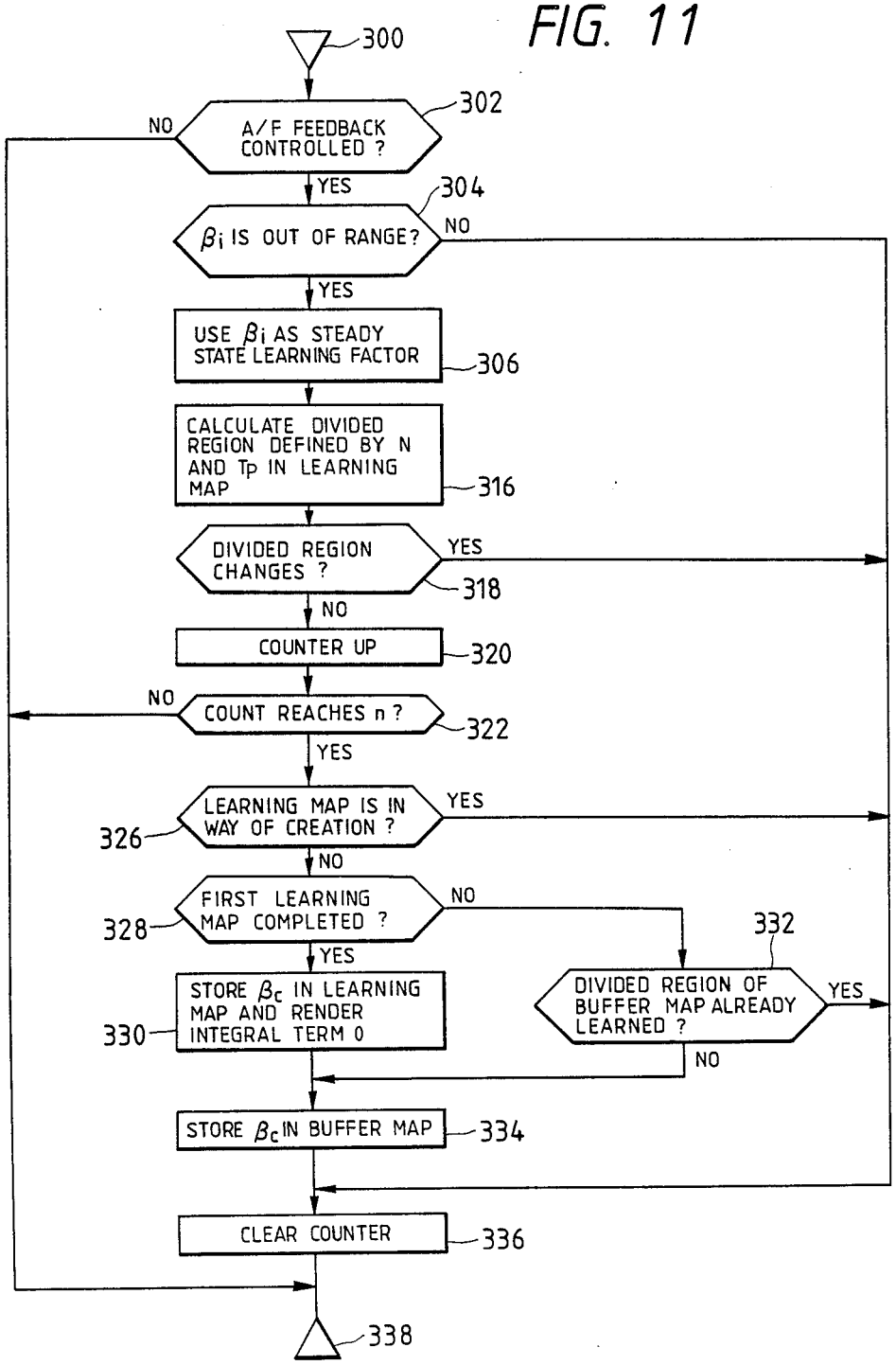
FIG. 11 is a flow chart illustrating a steady state learning process for renewing a steady state learning map used in the present invention.

An example of the learning routine of the steady state learning coefficient (learning factor) $\beta c$ will be explained with reference to FIG. 11. After the start of the engine, the processing according to the flow chart from the step 300 to the step 338 is repeated at a predetermined period. At the step 302, whether or not the air-fuel ratio is feedback controlled is first judged, and if the answer is Yes, the process proceeds to the step 304, while in the case of No, the process proceeds to the step 338. At the step 304, the control variable $\beta i$ is checked and if it is out of the range between the lower limit value and the upper limit value, the process proceeds to the step 306, while if it is in this range, the process proceeds to the step 336. At the step 306, the learning coefficient $\beta c$ is calculated. That is, since the control variable $\beta i$ is a signed control variable, the control variable $\beta i$ itself functions as the steady state learning coefficient $\beta c$.

At the step 316, the divided region in the steady state learning map is calculated with reference to the number of revolutions of the engine and the fundamental fuel injection time shown in FIG. 9. At the step 318, whether or not the divided region calculated at the preceding processing period is the same as the thus-obtained divided region is checked. If the divided region is the same, the counter is subjected to increment at the step 320. If the counter reads n at the step 322, the process proceeds to the next step. If the steady state learning map is in the way of creation at the step 326, the process proceeds to the step 336. If the answer is in the negative, whether or not the first learning map has been completed is judged at the step 328. If the answer is Yes, the learning coefficient $\beta c$ is stored in the steady state learning map at the step 330, and the integral term is rendered zero. Then the control variable $\beta i$ moves in the vicinity of zero as shown in FIG. 8. If the first or initial steady state learning map has not been completed yet at the step 328, the process proceeds to the step 332, and if the divided region of the buffer map has already been learned, the process proceeds to the step 336 without performing double writing. If the answer is No at the step 332, the learning coefficient $\beta c$ is stored in the buffer map at the step 334 and the counter is cleared at the step 336.

In this way, the above described fuel control system in a gasoline engine or the like is capable of constantly producing an optimum air-fuel ratio without any special adjustment, especially, of the individual differences and a change with time of the properties of the sensors, actuators, etc. incorporated in the fuel control system.

Figure 12A:
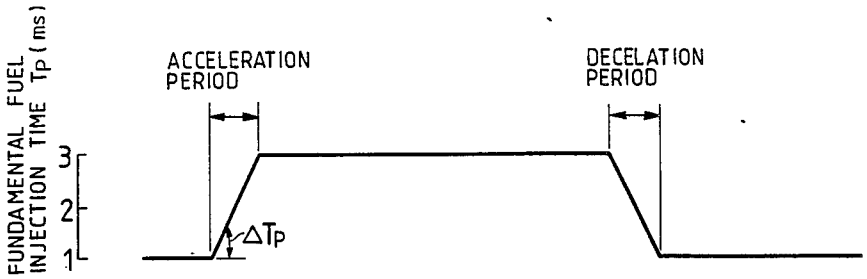
FIGS. 12(A) and 12(B) are graphs illustrating changes of fundamental fuel injection time during two transient periods and the corresponding changes of proportional components in a fundamental feedback correction coefficient which is used for determining a transient state learning correction coefficient according to the present invention.
Figure 12B:
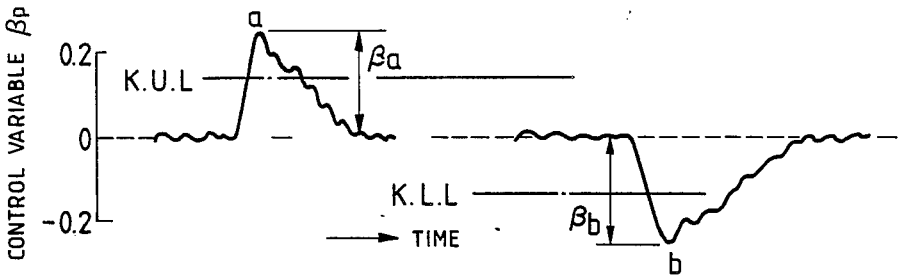

The relationship between the fundamental fuel injection time $T_P$ and the transient component control variable $\beta_P$ which relates to the proportional term in formula (4) is shown in FIGS. 12(A) and 12(B).

A change in the transient state is shown by the variance $\Delta T_P$ per predetermined unit time of the fundamental fuel injection time $T_P$ in FIGS. 12(A) and 12(B). In the accelerating period in which $\Delta T_P$ is increasing and in the decelerating period in which $\Delta T_P$ is decreasing, the control variable $\beta_P$ shows the extremes a and b, respectively. It is assumed that when the extremes a and b exceed the upper limit value (K.U.L) and are less than the lower limit value (K.L.L.), respectively, the control variable is rendered the accelerating learning factor $\beta a$ and the decelerating learning factor $\beta b$, respectively.

Figure 13:
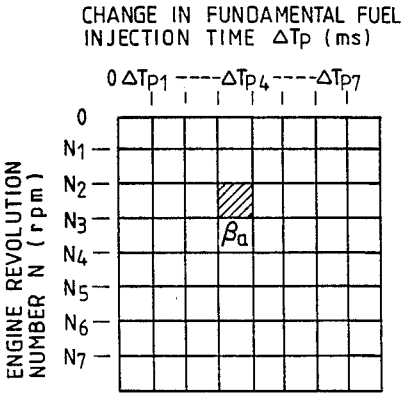
FIG. 13 is a conceptual constitution diagram of an accelerating state learning map storing learned correction coefficients and used in the present invention.
Figure 14:
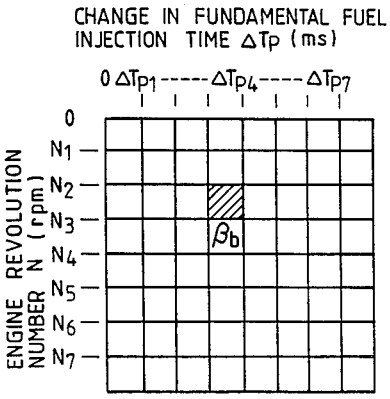
FIG. 14 is a conceptual constitution diagram of a decelerating state learning map storing learned correction coefficients and used in the present invention.

FIGS. 13 and 14 show an accelerating learning map and a decelerating learning map, respectively. Each of these maps consists of a variance $\Delta T_P$ of the fundamental fuel injection time and the number N of revolutions of the engine. The divided region is calculated from the number N of revolutions of the engine at the point where the maximum variance $\Delta T_P$ per predetermined unit time is detected during the accelerating or decelerating period and the learning value $\beta a$ and $\beta b$ at the extremes thereafter are written in the respective maps.

Figure 15:
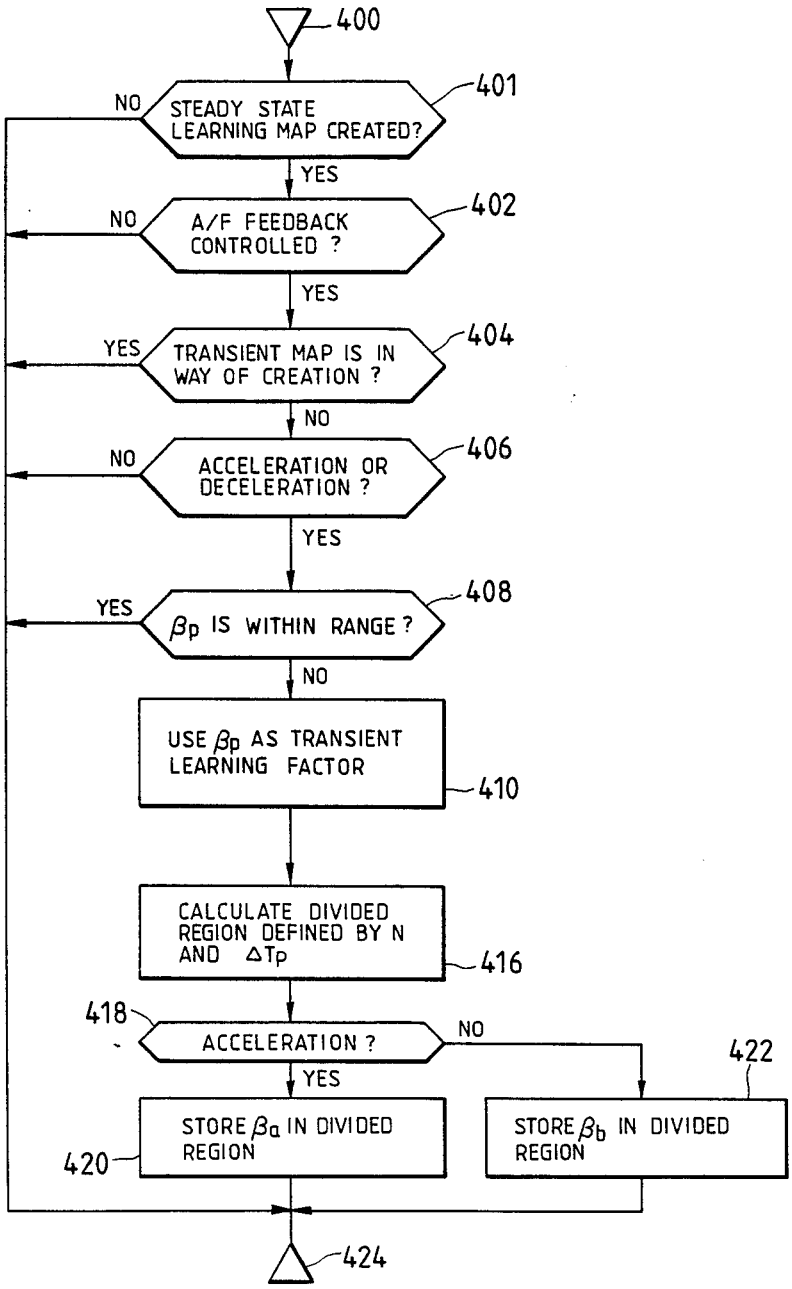
FIG. 15 is a flow chart illustrating a transient state learning process for renewing transient state learning maps used in the present invention.

FIG. 15 is a flow chart explaining an example of transient learning.

At the step 400, whether or not the learning map is already created or in usable condition is determined and if it is in unusable state, the process proceeds to the step 424. If it is in usable state, the process proceeds to the step 402, at which the feedback control of the air-fuel ratio is checked. If the air-fuel ratio is being feedback controlled, the process proceeds to the step 404, while it is not being feedback controlled, the process proceeds to the step 424. At the step 404, whether or not the accelerating or decelerating learning map is being created is checked, and if either of them is in the course of creation, the process proceeds to the step 424, while if neither is in the course of creation, the process proceeds to the step 406. At the step 406, whether the engine is in the accelerated or decelerated state is judged. If it is in the accelerated or decelerated state, the process proceeds to the step 408, while if it is not in the accelerated or decelerated state, the process proceeds to the step 424. The acceleration and deceleration are judged by comparing the variance $\Delta T_P$ of the fundamental fuel injection time with a predetermined value. At the step 408, judgment is made as to whether or not the control variable $\beta_P$ is in the range between the lower limit value (KLL) and the upper limit value (KUL) shown in FIG. 12(B). If it is in the range between the lower limit value (KLL) and the upper limit value (KUL), the process proceeds to the step 424. If the answer is No, the process proceeds to the step 410. At the step 410, the control variable $\beta_P$ is used as the transient learning factor.

At the step 416, the divided region is calculated from the number N of revolutions of the engine and the variance Tp of the fuel injection time at the point where the acceleration or deceleration is detected. At the step 418, whether the acceleration or the deceleration is judged at the time when the transient state was detected. If the answer is the acceleration, the accelerating learning coefficient $\beta a$ is stored in the accelerating learning map at the step 420, while in the case of the deceleration, the decelerating learning coefficient $\beta_b$ is stored in the decelerating learning map at the step 422.

For determining the fuel injection time Ti, the transient state learning correction coefficient $\beta$dyn as well as the steady state learning correction coefficient $\beta_c$ are used together with the fundamental feedback correction coefficient $\beta_0$.

As the transient learning value $\beta$dyn, either the accelerating learning value $\beta a$ or the decelerating learning value $\beta b$ is used, and when the engine is in the steady operating state, only the steady state learning value $\beta c$ is used.

According to the present invention, since the air-fuel ratio is controlled for each cylinder so as to make the air-fuel ratio uniform for each cylinder, the roughness during idling is advantageously reduced and autotuning is enabled. During lean combustion, since the air-fuel ratio between the cylinders is made uniform, it is possible to extend the lean limit. In addition, since the air-fuel ratio between the cylinders is controllable, it is possible to increase each gain of proportional, integral and differential terms for the air-fuel ratio feedback control, thereby improving the controllability of the air-fuel ratio. The fluctuation in the torque and, hence, the vibration is therefore reduced, thereby providing the improved riding comfort.

Moreover according to the present invention, not only are the individual differences and a change with time of the properties of the sensors and the actuators related to air-fuel ratio control compensated for, but also the air-fuel ratio during acceleration or deceleration is controlled with high accuracy.

We claim:

1. A method of feedback controlling air and fuel ratio of the mixture supplied to an internal combustion engine having plurality of cylinders comprising the steps of:

detecting air and fuel ratio in the exhaust gas of the internal combustion engine in synchronization with the engine rotation with an air and fuel sensor having a substantially linear output characteristic in response to air and fuel ratio variation;

discriminating one of the cylinders of which an air and fuel ratio in exhaust gas has been detected in said detecting step;

calculating an average air and fuel ratio of the total cylinders detected in said preceding detecting steps at least once for the respective cylinders;

determining a fundamental correction coefficient for one of the cylinders being in the way to suction stroke by at least taking into account of proportional and integral components of the deviation of the average air and fuel ratio obtained in said calculating step from a desired air and fuel ratio;

retrieving a learning correction coefficient according to the engine operating condition for the one of the cylinders being in the way to suction stroke from a memory in the form of map, learning correction coefficients according to various engine operating conditions learned previously being stored in respective memories in the form of maps for the respective cylinders;

further determining a fuel injection time for the one of the cylinders being in the way to suction stroke using the fundamental correction coefficient obtained in said first determining step and the learning correction coefficient obtained in said retrieving step;

learning a new learning correction coefficient according to the engine operating condition for the one of the cylinders discriminated in said discriminating step by taking into account of the intrinsic deviation of the air and fuel ratio obtained in said detecting step from the average air and fuel ratio obtained in said calculating step; and renewing a learning correction coefficient of the corresponding engine operating condition previously learned and stored in the memory in the form of map for the one of the cylinder discriminated with the new learning correction coefficient learned in said learning step.

2. The method according to claim 1 wherein said learning step includes the steps:

calculating the intrinsic deviation of the air and fuel ratio detected in said detecting step for the one of the cylinders discriminated in said discriminating step from the average air and fuel ratio obtained in said first calculating step; and further determining a new learning correction coefficient for the engine operating condition by taking into account the intrinsic deviation obtained in said second calculating step.

3. The method according to claim 2 wherein the intrinsic deviation obtained in said second calculating step is used for determining the new learning correction coefficient only when the obtained deviation exceeds a predetermined range.

4. The method according to claim 1, wherein said learning step is performed in a steady state operating condition of the internal combustion engine.

5. The method according to claim 4 wherein said steady state operating condition of the internal combustion engine is determined when instant deviations of engine speed and load from those of average values obtained at least once for the respective cylinders are within respective predetermined values.

6. The method according to claim 4, wherein said learning step is further performed in a transient state operating condition of the internal combustion engine, said learning step in the transient operating condition of the internal combustion engine is performed after the respective memories in the form of maps storing steady state learning correction coefficients for the respective cylinders have been initially completed.

* * * * *